US008341953B2

(12) United States Patent
Murakami et al.

(10) Patent No.: US 8,341,953 B2
(45) Date of Patent: Jan. 1, 2013

(54) EXHAUST MANIFOLD

(75) Inventors: Nobuyuki Murakami, Toyota (JP); Hiroshi Hosoi, Nissin (JP); Katsumi Yagi, Ichinomiya (JP); Kimihiro Jinno, Toukai (JP); Tatsuki Fukagawa, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 592 days.

(21) Appl. No.: 12/612,296

(22) Filed: Nov. 4, 2009

(65) Prior Publication Data

US 2010/0126158 A1 May 27, 2010

(30) Foreign Application Priority Data

Nov. 25, 2008 (JP) ..... 2008-299741

(51) Int. Cl.
*F01N 1/00* (2006.01)
*F16L 9/14* (2006.01)

(52) U.S. Cl. ..... 60/323; 138/142; 138/143; 138/148

(58) Field of Classification Search ..... 60/323, 60/324; 138/140, 142, 143, 148, 149, 151
See application file for complete search history.

(56) References Cited

U.S. PATENT DOCUMENTS 5,419,127 A * 5/1995 Moore, III ..... 60/322
5,953,912 A * 9/1999 Kaiho et al. ..... 60/323
6,155,046 A * 12/2000 Kato et al. ..... 60/323

FOREIGN PATENT DOCUMENTS

JP 7-224649 8/1995
JP 9-119314 5/1997
JP 10-252457 9/1998
JP 11-62575 3/1999

OTHER PUBLICATIONS

U.S. Appl. No. 12/612,281, filed Nov. 4, 2009, Murakami, et al.

* cited by examiner

*Primary Examiner* — Kenneth Bomberg
*Assistant Examiner* — Audrey K Bradley
(74) *Attorney, Agent, or Firm* — Oblon, Spivak, McClelland, Maier & Neustadt, L.L.P.

(57) ABSTRACT

An exhaust manifold includes: a double collecting pipe having an inner pipe, including a collecting pipe portion and branch pipe portions, and an outer pipe, covering the collecting and branch pipe portions and thicker than the inner pipe; and an inner pipe retainer having semi-circular portions and a connecting portion, and thicker than the inner pipe and thinner than the outer pipe. The inner pipe retainer connects the inner and outer pipes with a gap therebetween. Exhaust gas from exhaust ports of a set of cylinders is introduced into the collecting pipe portion through the branch pipe portions. The total spot-welded area of the outer peripheral portions of the branch pipe portions and the inner peripheral portions of the semi-circular portions is larger than that of the inner peripheral portion of the outer pipe and the outer peripheral portions of the semi-circular portions.

14 Claims, 11 Drawing Sheets

EXHAUST MANIFOLD

INCORPORATION BY REFERENCE

The disclosure of Japanese Patent Application No. 2008-299741 filed on Nov. 25, 2008 including the specification, drawings and abstract is incorporated herein by reference in its entirety.

BACKGROUND OF THE INVENTION

1. Field of the Invention

The invention relates to an exhaust manifold and, more specifically, to an exhaust manifold that includes a double collecting pipe that guides exhaust gas from exhaust ports of a set of cylinders.

2. Description of the Related Art

Generally, an internal combustion engine (engine) has a catalyst arranged in an exhaust passage to purify exhaust gas. However, when the temperature of the catalyst is lower than its active temperature, it is difficult to ensure favorable exhaust gas purification performance. Therefore, it is necessary to promptly heat the catalyst to the active temperature, for example, when the engine is started.

Japanese Patent Application Publication No. 7-224649 (JP-A-7-224649) describes a double exhaust pipe. The double exhaust pipe includes an inner pipe and an outer pipe that are arranged via a heat insulating layer, such as an air layer. Exhaust gas flows through the inner pipe.

In the above double exhaust pipe, the outer pipe ensures structural strength, and the thickness of the inner pipe that constitutes an exhaust gas passage is reduced to make it possible to decrease the heat capacity of a portion that contacts exhaust gas. In addition, the heat insulating layer is provided between the inner pipe and the outer pipe, so it is possible to reduce radiation of heat through the outer pipe.

Thus, when the engine is started, the temperature of an inner wall of the exhaust manifold may be quickly increased. Hence, the effect of insulating heat of exhaust gas is improved to make it possible to quickly heat the catalyst to the active temperature.

In addition, Japanese Patent Application Publication No. 10-252457 (JP-A-10-252457) describes an exhaust manifold of this type. Upstream pipes are respectively connected to exhaust ports of an engine. Each of the upstream pipes has a double pipe structure formed of an inner pipe and an outer pipe. The exhaust manifold includes a double collecting pipe that collects a set of the upstream pipes, each of which is formed of the double pipe. The shapes of these upstream pipes and double collecting pipe are simplified to reduce the size of the exhaust manifold.

The double collecting pipe is formed of a common inner pipe and a common outer pipe. The common inner pipe includes a collecting pipe portion and branch pipe portions that are bifurcated from the collecting pipe portion. The common outer pipe covers an outer peripheral portion of the common inner pipe with a certain gap from the common inner pipe. Exhaust gas exhausted from the set of exhaust ports is collected at the double collecting pipe. Thus, the shapes of these upstream pipes and double collecting pipe are simplified to make it possible to reduce the size of the exhaust manifold.

In addition, the double collecting pipe is formed so that the common inner pipe is directly welded to the common outer pipe to attach the common inner pipe to the common outer pipe.

However, in the exhaust manifold described in JP-A-10-252457, the common inner pipe is welded to the common outer pipe. However, a difference in thermal expansion increases between the thin common inner pipe exposed to high-temperature exhaust gas and the thick common outer pipe exposed to outside air. Thus, the common inner pipe deforms against the common outer pipe.

That is, when the thin common inner pipe deforms at a high temperature, the thick common outer pipe does not follow the deformation of the common inner pipe. Therefore, stress at the branched portion of the common inner pipe increases, and the branch pipe portions of the common inner pipe get close to each other. This causes a deformation such that a portion between the branched portions of the branch pipe portions lifts. For this reason, the branched portion of the branch pipe portions forms cracks and is damaged, thus decreasing reliability of the exhaust manifold.

SUMMARY OF THE INVENTION

The invention provides an exhaust manifold that is able to prevent damage to a branch portion by reducing stress of branch pipe portions of an inner pipe when the inner pipe is subjected to high-temperature exhaust gas, and that can improve reliability.

An aspect of the invention relates to an exhaust manifold. The exhaust manifold includes: a double collecting pipe that is formed of an inner pipe and an outer pipe, wherein the inner pipe includes a collecting pipe portion and branch pipe portions that are bifurcated from the collecting pipe portion, the outer pipe covers an outer peripheral portion of the collecting pipe portion and outer peripheral portions of the branch pipe portions, and an inner pipe retainer that has a thickness larger than the thickness of the inner pipe and smaller than the thickness of the outer pipe and that is formed of a pair of semi-circular portions and a connecting portion, wherein the pair of semi-circular portions are respectively connected to outer peripheral portions of branched portions of the branch pipe portions and an inner peripheral portion of the outer pipe, the connecting portion connects the pair of semi-circular portions, and the inner pipe retainer is interposed between the inner pipe and the outer pipe and is connected to the inner pipe and the outer pipe so as to define a certain gap between the inner pipe and the outer pipe. In the above exhaust manifold, exhaust gas exhausted from exhaust ports of a set of cylinders among a plurality of cylinders of an engine is introduced into the collecting pipe portion through the branch pipe portions, and the inner peripheral portion of the outer pipe and outer peripheral portions of the semi-circular portions are connected by spot welding, the outer peripheral portions of the branch pipe portions and inner peripheral portions of the semi-circular portions are connected by spot-welding, the total area in which the outer peripheral portions of the branch pipe portions and the inner peripheral portions of the semi-circular portions are spot-welded is larger than the total area in which the inner peripheral portion of the outer pipe and the outer peripheral portions of the semi-circular portions are spot-welded.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
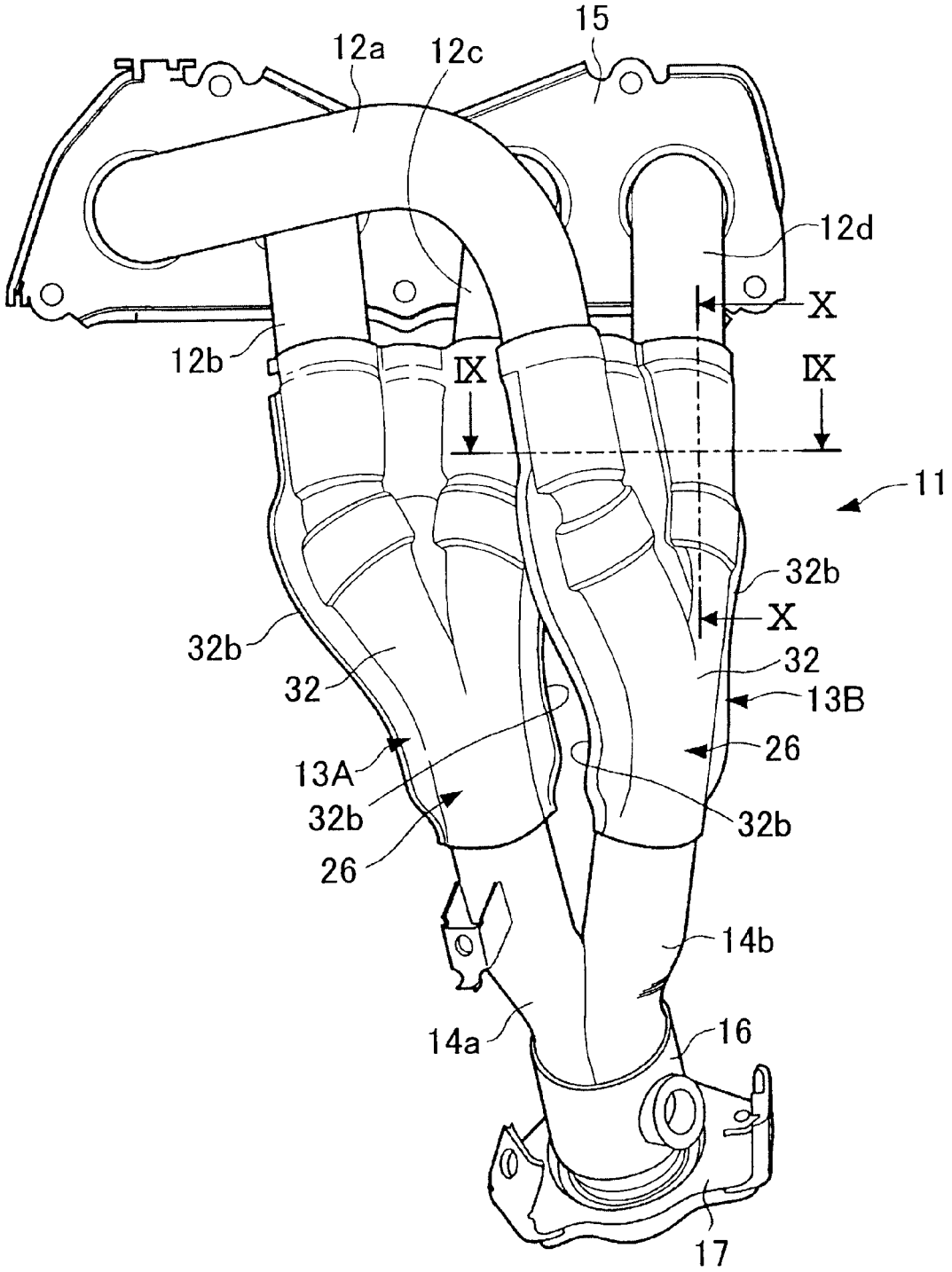
FIG. 1 is a view that shows an exhaust manifold according to an embodiment of the invention, and is a front view of the exhaust manifold.
Figure 2:
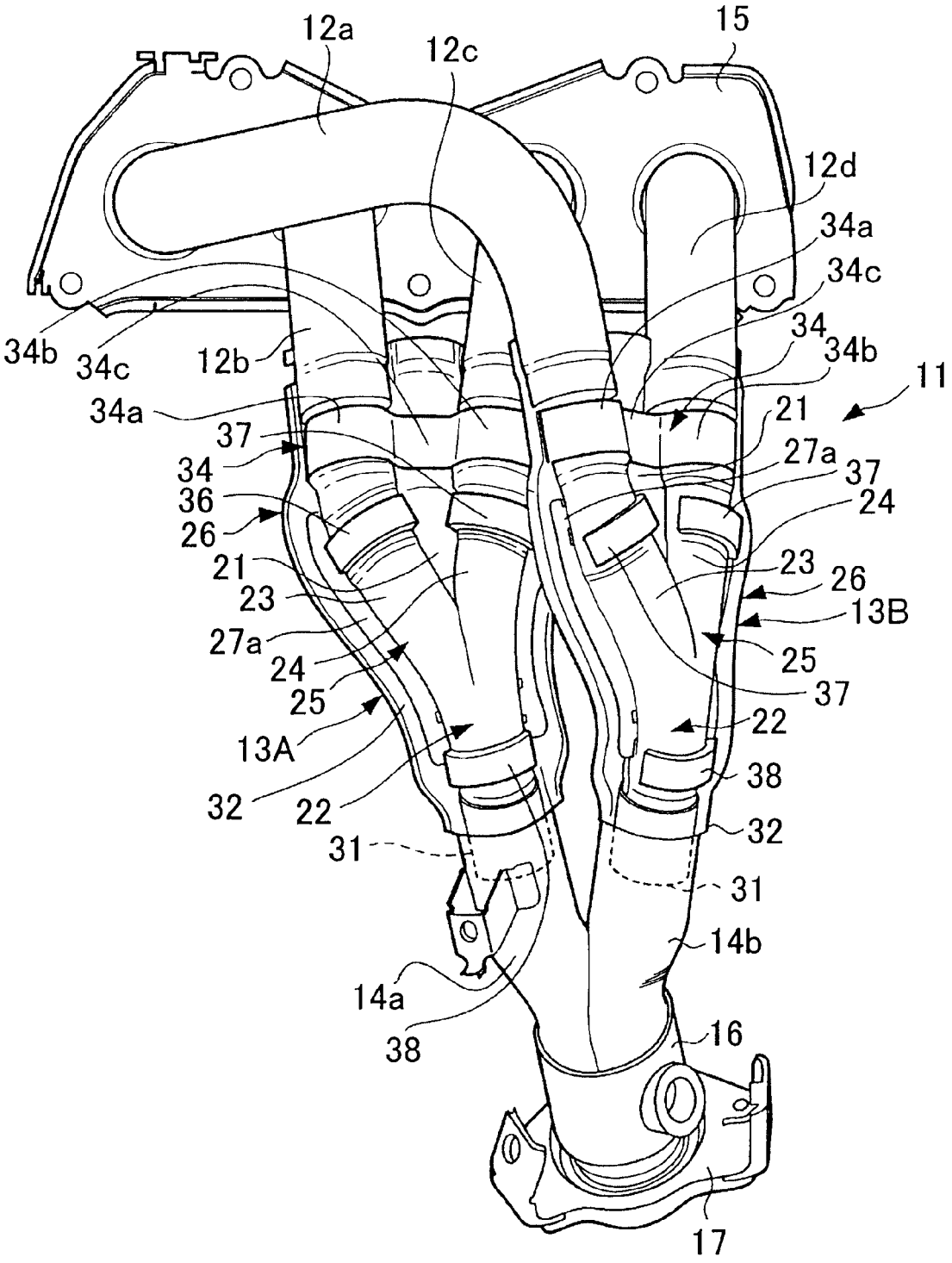
FIG. 2 is a view that shows the exhaust manifold according to the embodiment of the invention, and is a front view of the exhaust manifold in a state where a half of an outer pipe of each double collecting pipe is removed.
Figure 3:
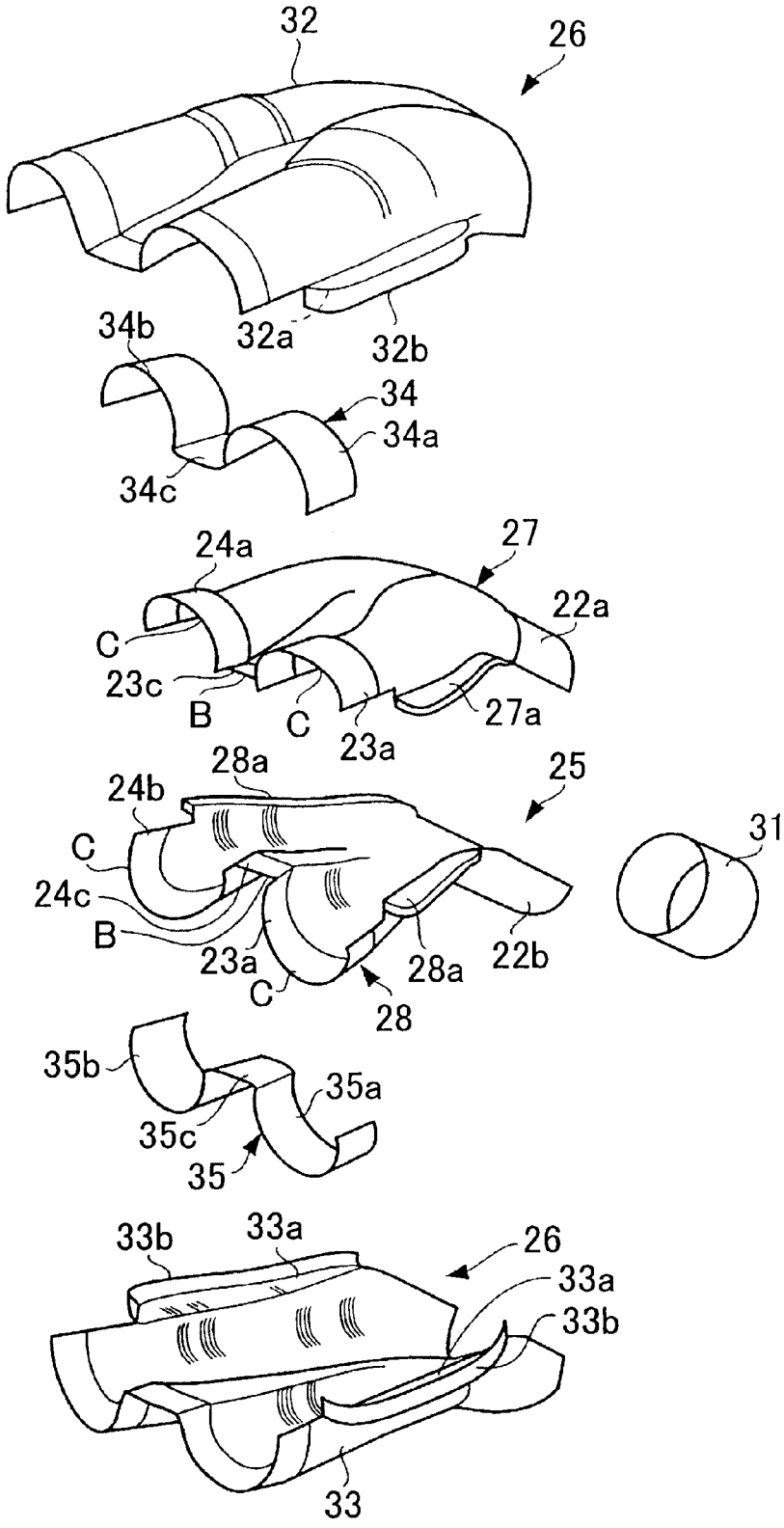
FIG. 3 is a view that shows the exhaust manifold according to the embodiment of the invention, and is an exploded view of the double collecting pipe.
Figure 4:
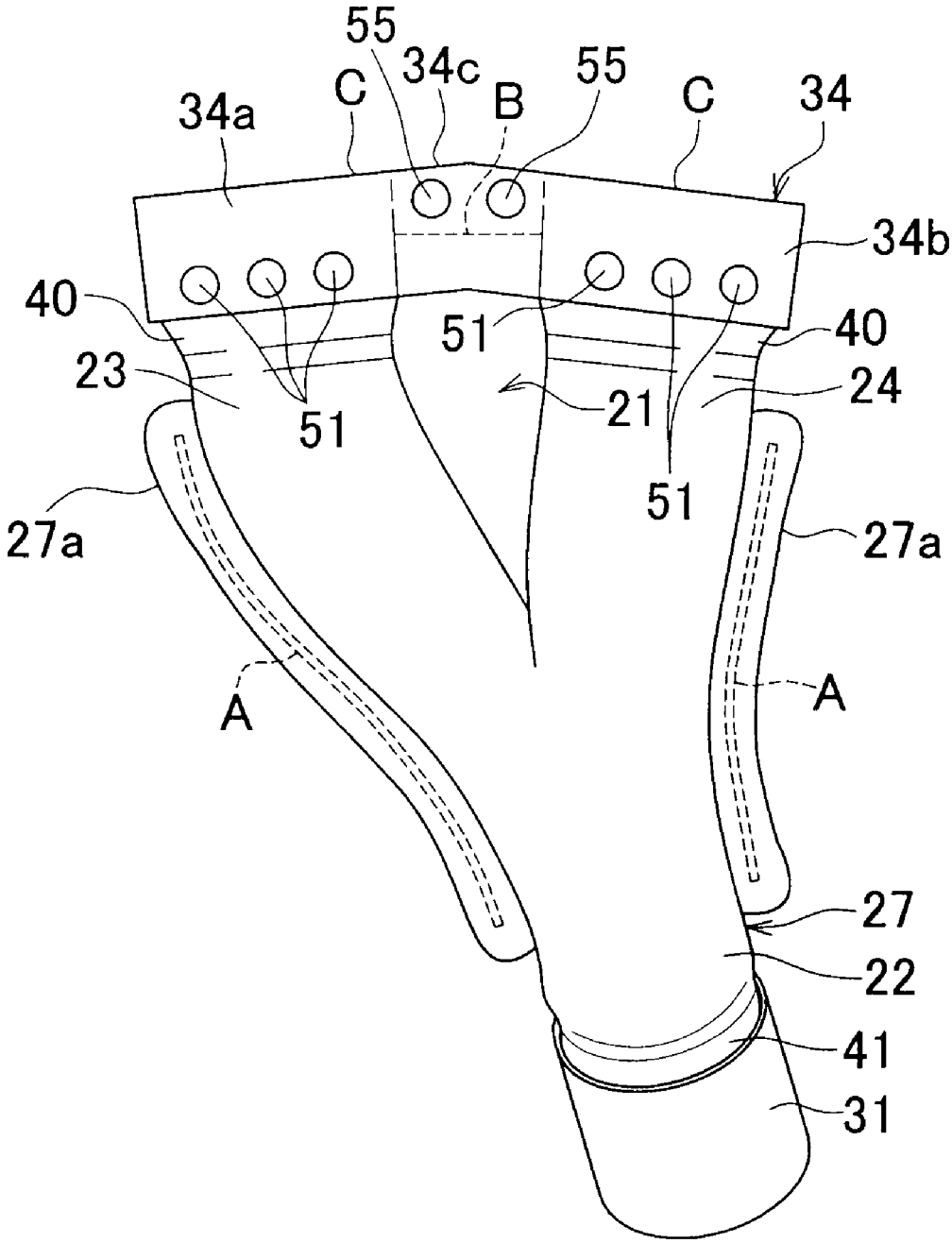
FIG. 4 is a view that shows the exhaust manifold according to the embodiment of the invention, and is a front view of an inner pipe.
Figure 5:
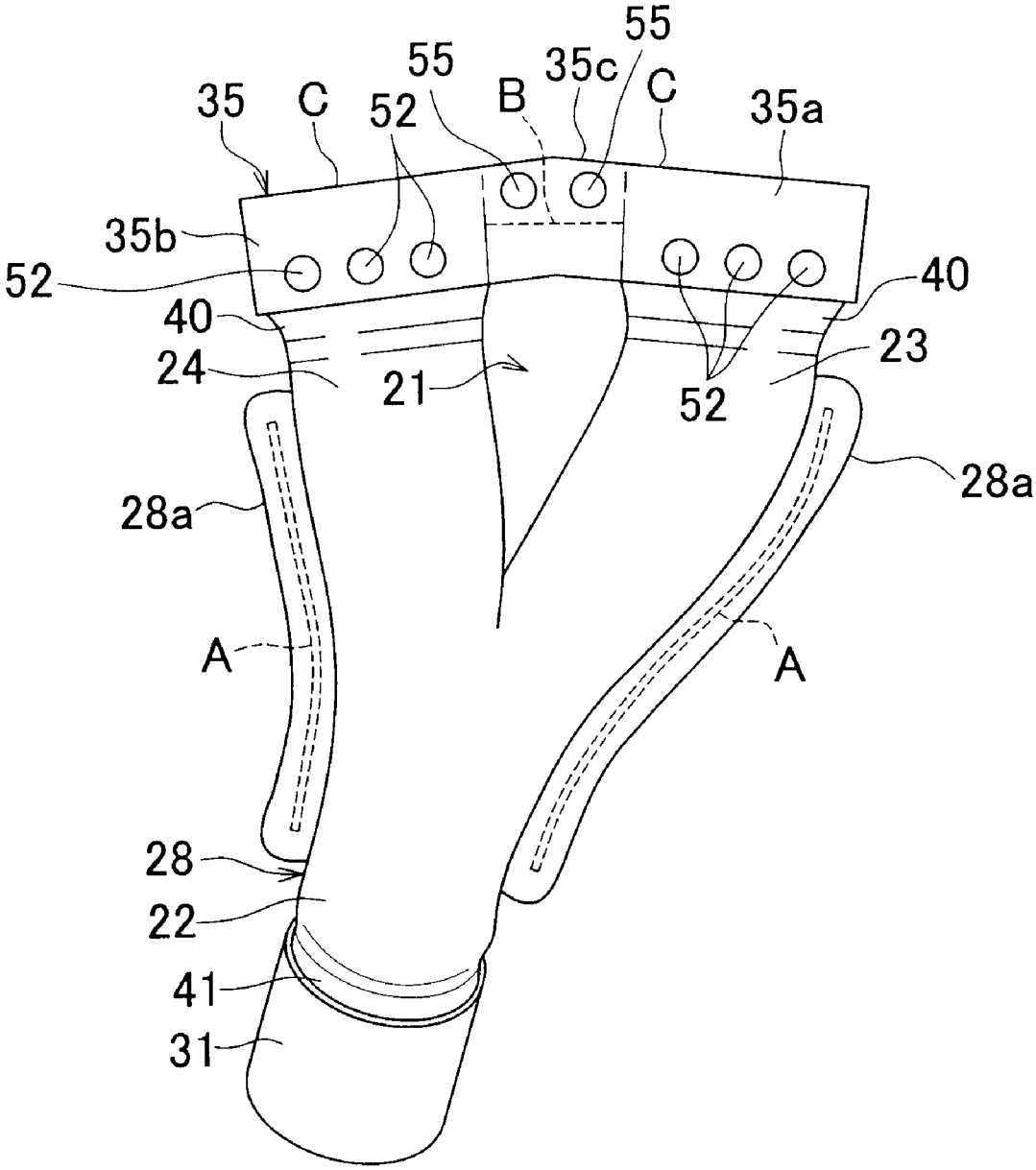
FIG. 5 is a view that shows the exhaust manifold according to the embodiment of the invention, and is a rear view of the inner pipe.
Figure 6:
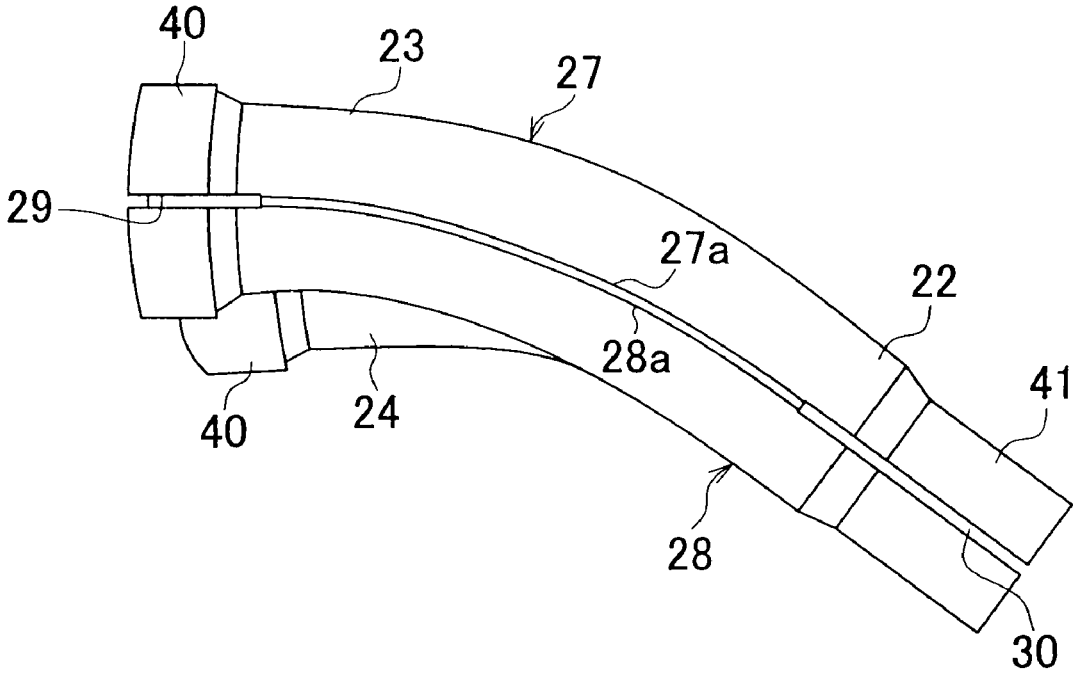
FIG. 6 is a view that shows the exhaust manifold according to the embodiment of the invention, and is a side view of the inner pipe.
Figure 7:
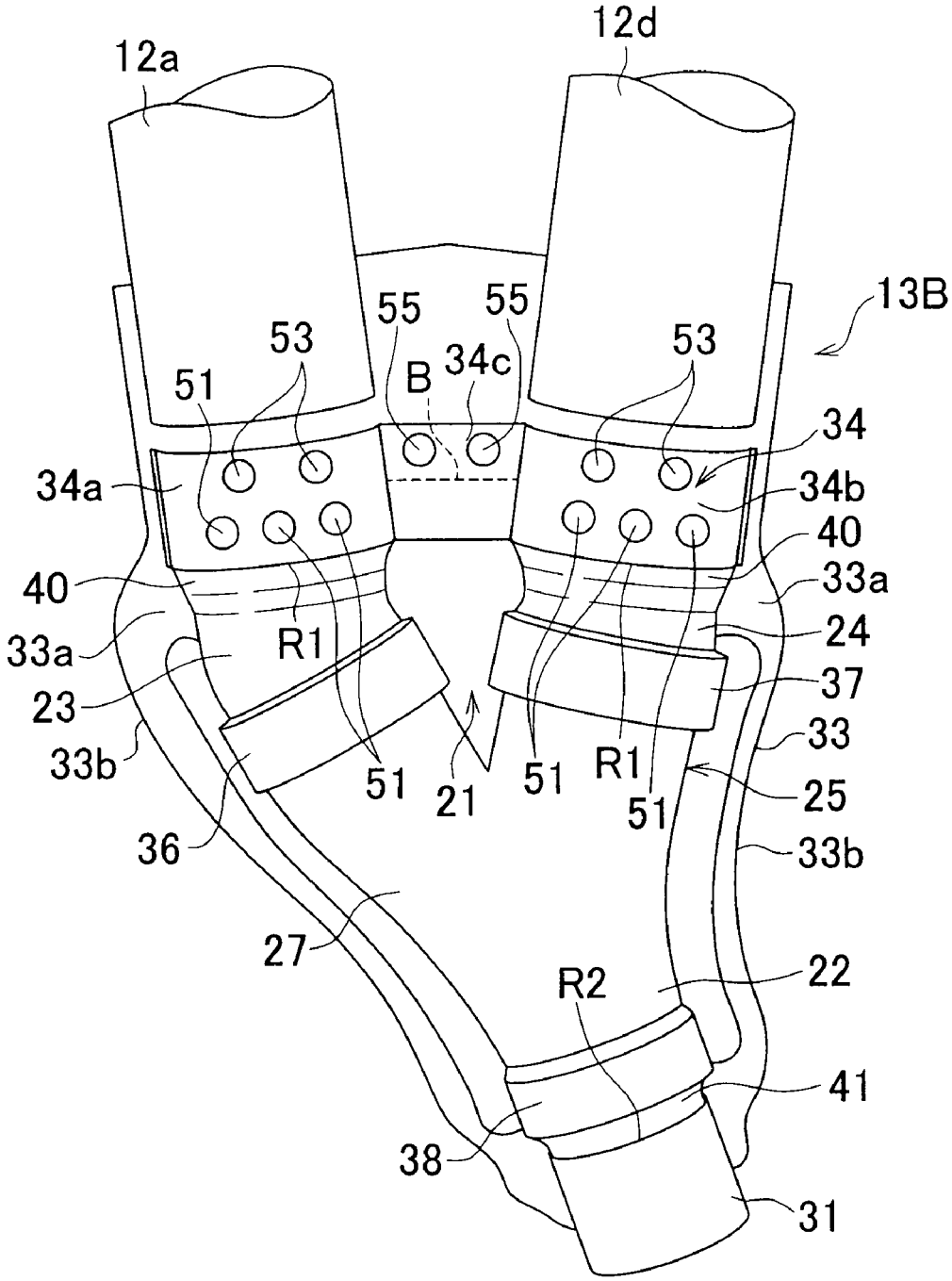
FIG. 7 is a view that shows the exhaust manifold according to the embodiment of the invention, and is a front view of the double collecting pipe in a state where a half of the outer pipe is removed.
Figure 8:
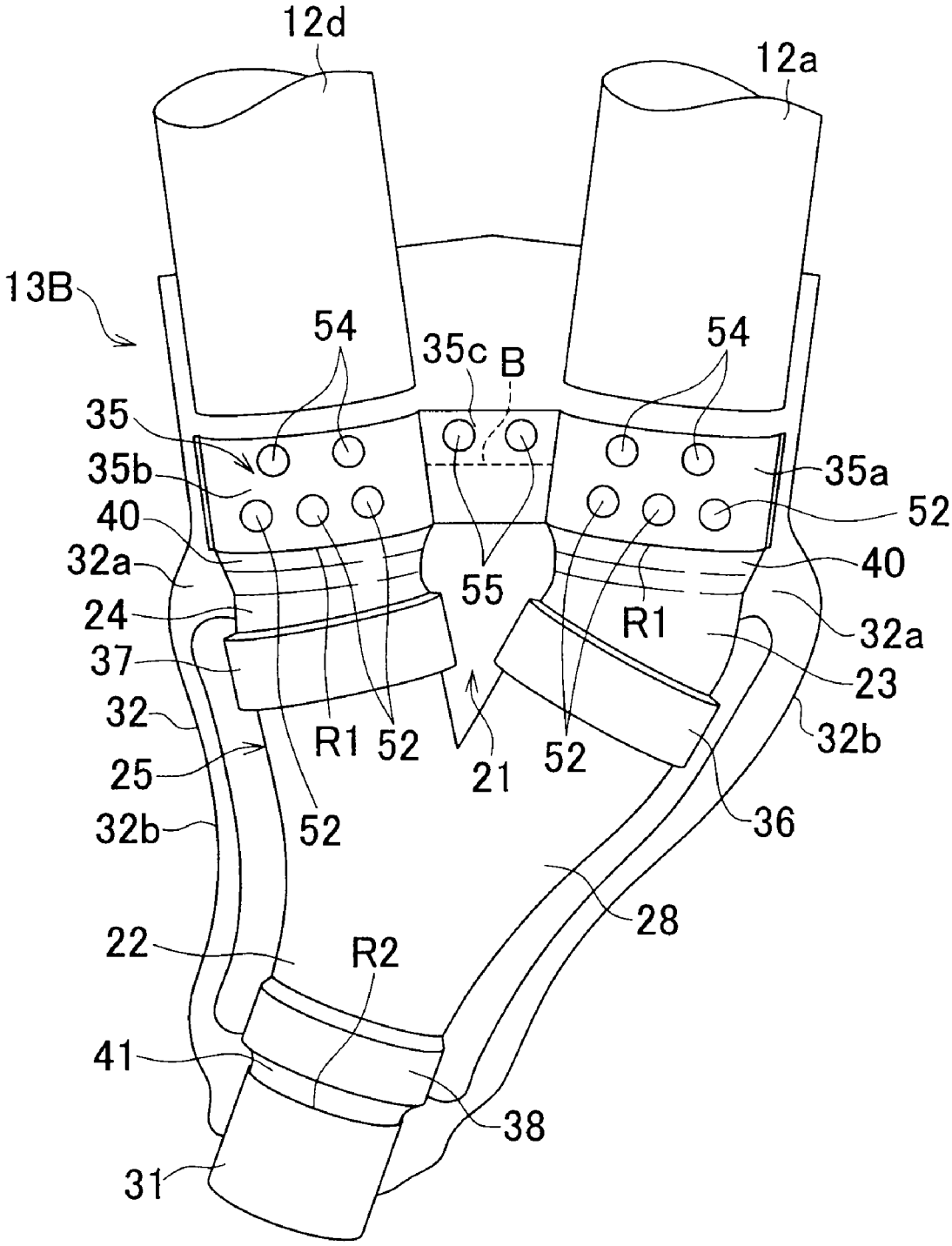
FIG. 8 is a view that shows the exhaust manifold according to the embodiment of the invention, and is a rear view of the double collecting pipe in a state where the other half of the outer pipe is removed.
Figure 9:
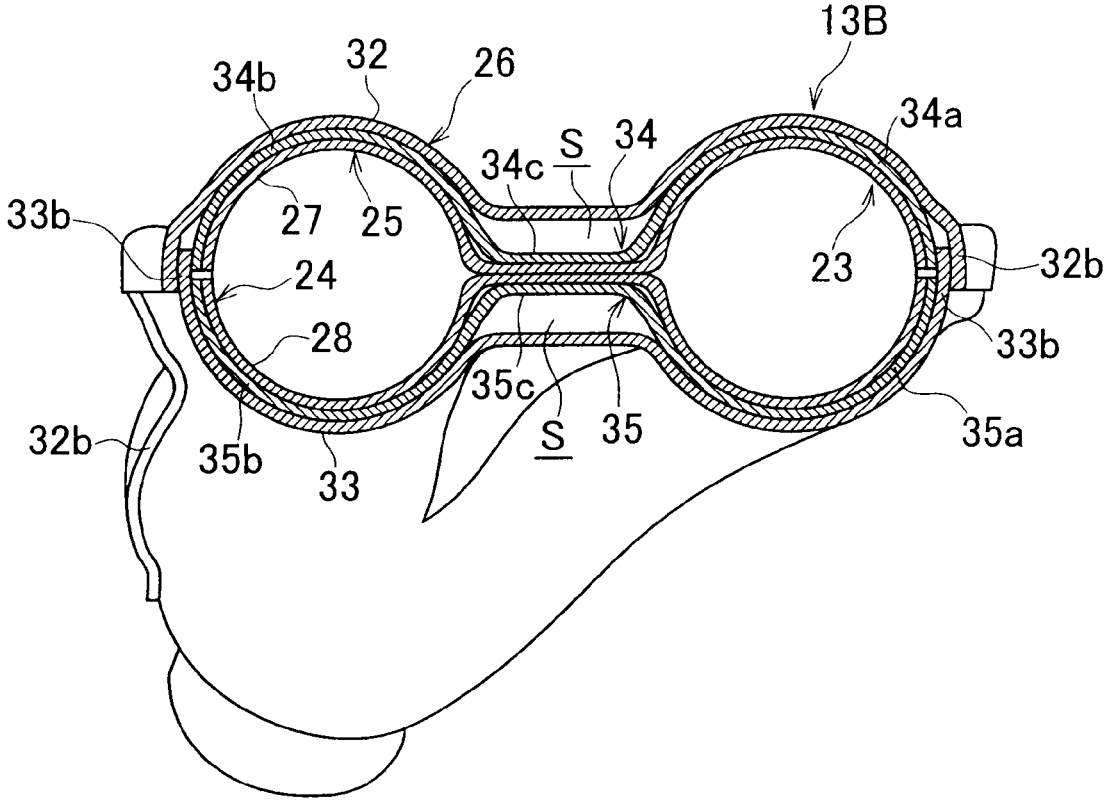
FIG. 9 is a view that shows the exhaust manifold according to the embodiment of the invention, and is a cross-sectional view taken along the line IX-IX in FIG. 1.
Figure 10:
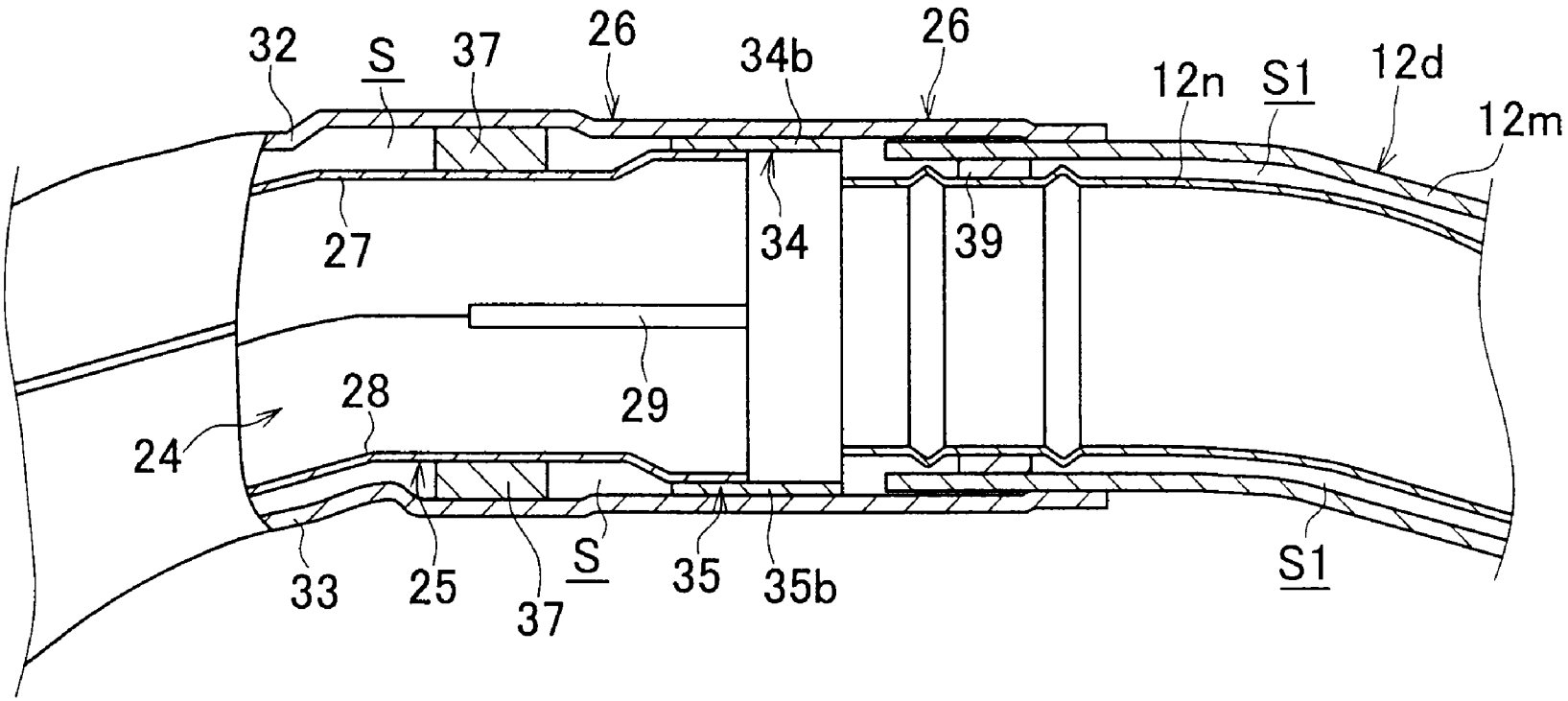
FIG. 10 is a view that shows the exhaust manifold according to the embodiment of the invention, and is a cross-sectional view taken along the line X-X in FIG. 1.
Figure 11:
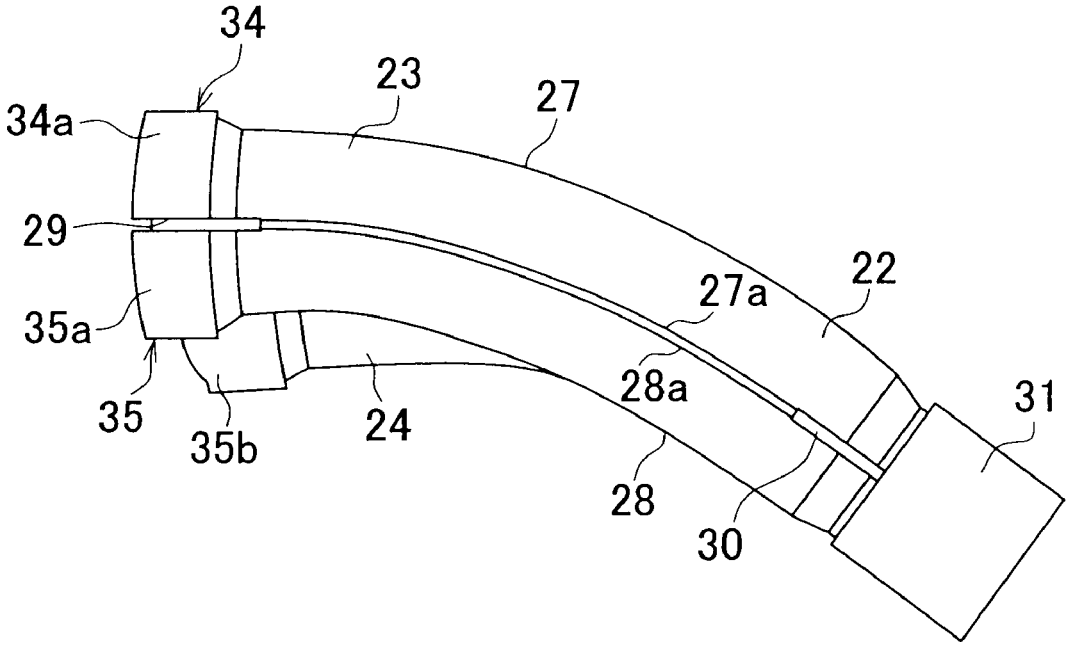
FIG. 11 is a view that shows the exhaust manifold according to the embodiment of the invention, and is a side view of the inner pipe to which a reinforcement pipe and inner pipe retainers are attached.

Hereinafter, an exhaust manifold according to an embodiment of the invention will be described with reference to the accompanying drawings. FIG. 1 to FIG. 11 are views that show the exhaust manifold according to the embodiment of the invention. Note that FIG. 1 is a front view of the exhaust manifold, FIG. 2 is a front view of the exhaust manifold in a state where a half of an outer pipe of each double collecting pipe is removed, FIG. 3 is an exploded view of the double collecting pipe, FIG. 4 is a front view of the inner pipe, FIG. 5 is a rear view of the inner pipe, FIG. 6 is a side view of the inner pipe, FIG. 7 is a front view of the double collecting pipe in a state where a half of the outer pipe is removed, FIG. 8 is a rear view of the double collecting pipe in a state where the other half of the outer pipe is removed, FIG. 9 is a cross-sectional view taken along the line IX-IX in FIG. 1, FIG. 10 is a cross-sectional view taken along the line X-X in FIG. 1, and FIG. 11 is a side view of the inner pipe to which a reinforcement pipe and inner pipe retainers are attached.

First, the configuration will be described. As shown in FIG. 1 and FIG. 2, the exhaust manifold 11 is attached to a cylinder head of an in-line four-cylinder engine (not shown). The exhaust manifold 11 includes a plurality of independent upstream pipes 12*a*, 12*b*, 12*c* and 12*d*, double collecting pipes 13A and 13B and a set of downstream pipes 14*a* and 14*b*. The double collecting pipes 13A and 13B are connected to a corresponding one of pairs of the upstream pipes 12*a* and 12*d*, 12*b* and 12*c*. The set of downstream pipes 14*a* and 14*b* are connected respectively to the double collecting pipes 13A and 13B.

Each of the upstream pipes 12*a* to 12*d* includes an inner pipe 12*n* and an outer pipe 12*m*. The outer pipe 12*m* is thicker than the inner pipe 12*n*. The outer pipe 12*m* is attached to an outer peripheral portion of the inner pipe 12*n* with a certain gap S1 (see FIG. 10) formed between the inner pipe 12*n* and the outer pipe 12*m*. A flange portion 15 is attached to upstream portions, in an exhaust direction in which exhaust gas flows, (hereinafter, simply referred to as "upstream portions") of the upstream pipes 12*a* to 12*d*. Note that the outer pipes of the upstream pipes 12*a* to 12*d* are fixedly welded to the flange portion 15.

The flange portion 15 is fixed to the cylinder head by bolts, or the like. Exhaust gas is exhausted from exhaust ports of cylinders of an engine into the upstream pipes 12*a* to 12*d*.

In addition, in the present embodiment, the upstream pipe 12*a* is in fluid communication with the exhaust port of the first cylinder of the engine, the upstream pipe 12*b* is in fluid communication with the exhaust port of the second cylinder of the engine, the upstream pipe 12*c* is in fluid communication with the exhaust port of the third cylinder of the engine, and the upstream pipe 12*d* is in fluid communication with the exhaust port of the fourth cylinder of the engine.

In addition, the double collecting pipe 13A is connected to the downstream side of the upstream pipe 12*b* that is in fluid communication with the exhaust port of the second cylinder and the downstream side of the upstream pipe 12*c* that is in fluid communication with the exhaust port of the third cylinder. The other double collecting pipe 13B is connected to a downstream portion, in the exhaust direction, (hereinafter, simply referred to as "downstream portion") of the upstream pipe 12*a* that is in fluid communication with the exhaust port of the first cylinder and a downstream portion of the upstream pipe 12*d* that is in fluid communication with the exhaust port of the fourth cylinder.

Here, the in-line four-cylinder engine is a four-stroke gasoline engine. The combustion stroke takes place in the order of the first cylinder, the third cylinder, the fourth cylinder and the second cylinder. Exhaust gas is introduced into the double collecting pipe 13A from the exhaust port of the second cylinder and the exhaust port of the third cylinder through the upstream pipes 12*b* and 12*c*. The respective combustion strokes of the second cylinder and the third cylinder do not take place at the same time. Exhaust gas is introduced into the double collecting pipe 13B from the exhaust port of the first cylinder and the exhaust port of the fourth cylinder through the upstream pipes 12*a* and 12*d*. The respective combustion strokes of the first cylinder and the fourth cylinder do not take place at the same time.

Next, the configuration of each of the double collecting pipes 13A and 13B will be described with reference to FIG. 3 to FIG. 11. Note that the configuration of the double collecting pipe 13A is the same as that of the double collecting pipe 13B, so only the components of the double collecting pipe 13B will be described with reference to FIG. 3 to FIG. 11, and the description regarding the components of the double collecting pipe 13A is omitted.

As shown in FIG. 2, each of the double collecting pipes 13A and 13B includes an inner pipe 25 and an outer pipe 26 (see FIG. 1). The inner pipe 25 includes a collecting pipe portion 22 and branch pipe portions 23 and 24. The branch pipe portions 23 and 24 are bifurcated from the collecting pipe portion 22. The outer pipe 26 covers the outer peripheral portion of the collecting pipe portion 22 and the outer peripheral portions of the branch pipe portions 23 and 24.

As shown in FIG. 3, the inner pipe 25 includes half inner pipes 27 and 28 that have a half shape. The half inner pipe 27 includes half branch pipe portions 23*a* and 24*a* and a half collecting pipe portion 22*a*. The half inner pipe 28 includes half branch pipe portions 23*b* and 24*b* and a half collecting pipe portion 22*b*. The half branch pipe portions 23*a* and 23*b* constitute the branch pipe portion 23. The half branch pipe portions 24*a* and 24*b* constitute the branch pipe portion 24. The half collecting pipe portions 22*a* and 22*b* constitute the collecting pipe portion 22. Flange portions 27*a* and 28*a* are respectively formed at both ends, in the width direction, of the half inner pipes 27 and 28. The flange portions 27*a* and 28*a* are connected by welding to integrate the half inner pipes 27 and 28.

In addition, the half branch pipe portions 23*a* and 24*a* of the half inner pipe 27 are spaced apart from each other via a thin-walled portion 23*c*. The half branch pipe portions 23*b* and 24*b* of the half inner pipe 28 are spaced apart from each other via a thin-walled portion 24*c*. Upstream ends B of the thin-walled portions 23*c* and 24*c* are located on the downstream side with respect to upstream ends C of the half branch pipe portions 23*a*, 23*b*, 24*a* and 24*b*. Thus, a gap is formed between the upstream portions of the half branch pipe portions 23*a* and 24*a*, and a gap is formed between the upstream portions of the half branch pipe portions 23*b* and 24*b*. Note that, in the inner pipe 25 integrated by connecting the half inner pipes 27 and 28 at the flange portions 27*a* and 28*a*, the thin-walled portions 23*c* and 24*c* are termed a thin-walled portion 21.

In addition, as indicated by the broken line in FIG. 4 and FIG. 5, welded portions A for connecting the flange portions 27*a* and 28*a* are prepared at portions, other than upstream portions and downstream portions, of the flange portions 27*a* and 28*a* in directions in which the flange portions 27*a* and 28*a* extend.

In addition, as shown in FIG. 3 and FIG. 6, the flange portions 27*a* and 28*a* are formed at both ends, in the width direction, of the half inner pipes 27 and 28 other than the upstream portions of the branch pipe portions 23 and 24 and the downstream portion of the collecting pipe portion 22. Front slits 29, which serve as slits, are respectively formed at facing surfaces of the upstream portions of the branch pipe portions 23 and 24. Rear slits 30, which serve as slits, are formed at facing surfaces of the downstream portion of the collecting pipe portion 22. Thus, the inner peripheral side of the branch pipe portions 23 and 24 and collecting pipe portion 22 is in fluid communication with the gap S defined between the inner pipe 25 and the outer pipe 26 via the front slits 29 and the rear slits 30.

In addition, as shown in FIG. 2, FIG. 4 and FIG. 5, a cylindrical reinforcement pipe 31 is provided at the downstream portion of the collecting pipe portion 22. The reinforcement pipe 31 is connected by welding to the downstream portion of the collecting pipe portion 22 so as to close part of the rear slits 30.

In addition, the outer pipe 26 is attached to the outer peripheral portion of the collecting pipe portion 22 and the outer peripheral portions of the branch pipe portions 23 and 24 so as to cover the collecting pipe portion 22 and the branch pipe portions 23 and 24. As shown in FIG. 3, the outer pipe 26 includes half outer pipes 32 and 33 that have a half shape. Accommodating portions 32*a* and 33*a* are formed at both ends, in the width direction, of the half outer pipes 32 and 33. The accommodating portions 32*a* and 33*a* accommodate the flange portions 27*a* and 28*a* of the half inner pipes 27 and 28. In addition, connecting portions 32*b* and 33*b* are formed at both ends of the accommodating portions 32*a* and 33*a*. The connecting portions 32*b* and 33*b* mutually protrude toward the opposite half outer pipes 33 and 32. The connecting portions 32*b* and 33*b* are welded to each other in a state where the connecting portions 32*b* and 33*b* are superimposed, so the half outer pipes 32 and 33 are integrated into the outer pipe 26.

In addition, as shown in FIG. 2, FIG. 3, FIG. 4, FIG. 5 and FIG. 7 to FIG. 11, inner pipe retainers 34 and 35 that have a half shape are interposed between the inner pipe 25 and the outer pipe 26. The inner pipe retainers 34 and 35 are connected to the inner pipe 25 and the outer pipe 26 by spot welding, so as to define a certain gap S (see FIG. 10), which constitutes an air layer (heat insulating layer), between the inner pipe 25 and the outer pipe 26.

Note that in FIG. 10, the downstream portion of the outer pipe 12*m* of the upstream pipe 12*d* is connected to the inner peripheral portion of the outer pipe 26 by welding, or the like. In addition, a wire mesh 39 is interposed between the inner pipe 12*n* and the outer pipe 12*m*. The wire mesh 39 forms a certain gap S1, which constitutes the air layer, between the inner pipe 12*n* and the outer pipe 12*m*, and absorbs vibrations when the vibrations occur in the exhaust manifold 11.

The inner pipe retainer 34 includes semi-circular portions 34*a* and 34*b* and a linear connecting portion 34*c*. The inner pipe retainer 35 includes semi-circular portions 35*a* and 35*b* and a linear connecting portion 35*c* The semi-circular portions 34*a*, 34*b*, 35*a* and 35*b* are connected to the outer peripheral portions of the branch pipe portions 23 and 24 and the inner peripheral portion of the outer pipe 26. The connecting portion 34*c* is integrated with the semi-circular portions 34*a* and 34*b*, and connects the semi-circular portions 34*a* and 34*b*. The connecting portion 35*c* is integrated with the semi-circular portions 35*a* and 35*b*, and connects the semi-circular portions 35*a* and 35*b*.

In the present embodiment, the inner pipe 25, the outer pipe 26 and the inner pipe retainers 34 and 35 are made of metal, such as stainless steel plate. The thickness of the outer pipe 26 is larger than the thickness of the inner pipe 25, the thickness of each of the inner pipe retainers 34 and 35 is larger than the thickness of the inner pipe 25 and is smaller than the thickness of the outer pipe 26. In addition, the thickness of the reinforcement pipe 31 is larger than the thickness of the inner pipe 25.

In the present embodiment, as shown in FIG. 4 and FIG. 7, the inner peripheral portions of the semi-circular portions 34*a* and 34*b* of the inner pipe retainer 34 each are spot-welded to the half inner pipe 27 of the inner pipe 25 at three portions (hereinafter, the welded portions are referred to as spot-welded portions 51). In addition, as shown in FIG. 5 and FIG. 8, the inner peripheral portions of the semi-circular portions 35*a* and 35*b* of the inner pipe retainer 35 each are spot-welded to the half inner pipe 28 of the inner pipe 25 at three portions (hereinafter, the welded portions are referred to as spot-welded portions 52).

In addition, as schematically shown in FIG. 7, the outer peripheral portions of the semi-circular portions 34*a* and 34*b* of the inner pipe retainer 34 each are spot-welded to the half outer pipe 32 of the outer pipe 26 at two portions (hereinafter, the welded portions are referred to as spot-welded portions 53). In addition, as schematically shown in FIG. 8, the outer peripheral portions of the semi-circular portions 35*a* and 35*b* of the inner pipe retainer 35 each are spot-welded to the half outer pipe 33 of the outer pipe 26 at two portions (hereinafter, the welded portions are referred to as spot-welded portions 54).

In the present embodiment, the welded areas of the respective spot-welded portions 51 to 54 are substantially equal to one another, and the total welded area of the spot-welded portions 51 and 52 formed between the outer peripheral portions of the branch pipe portions 23 and 24 and the inner peripheral portions of the semi-circular portions 34*a*, 34*b*, 35*a* and 35*b* of the inner pipe retainers 34 and 35 is larger than the total welded area of the spot-welded portions 53 and 54 formed between the inner peripheral portion of the outer pipe 26 and the outer peripheral portions of the semi-circular portions 34*a*, 34*b*, 35*a* and 35*b* of the inner pipe retainers 34 and 35.

In addition, as shown in FIG. 4, FIG. 5, FIG. 7 and FIG. 8, the connecting portions 34*c* and 35*c* of the inner pipe retainers 34 and 35, other than portions that clamp the thin-walled portion 21, are connected by spot-welding at two portions (hereinafter, the welded portions are referred to as spot-welded portions 55).

In the present embodiment, the connecting portions 34*c* and 35*c* are connected to clamp the upstream portions of the branch pipe portions 23 and 24, and the reinforcement pipe 31 is connected to the downstream portion of the collecting pipe portion 22. This prevents the branch pipe portions 23 and 24 and the collecting pipe portion 22 from deforming to radially increase the diameter by the pressure of exhaust gas, that is, prevents the inner pipe 25 from deforming in a direction in which the half inner pipes 27 and 28 separate from each other.

In addition, wire meshes 36, 37 and 38 that have a half shape are interposed between the inner pipe 25 and the outer pipe 26 so as to clamp the inner pipe 25. The wire meshes 36, 37 and 38 ensure a gap that forms the air layer S between the inner pipe 25 and the outer pipe 26, and absorbs vibrations when the vibrations occur in the exhaust manifold 11.

In addition, as shown in FIG. 4 to FIG. 8, the pipe diameter of the upstream portion of each of the branch pipe portions 23 and 24 of the inner pipe 25 is larger than the pipe diameter of a portion other than the upstream portion of each of the branch pipe portions 23 and 24 (hereinafter, the upstream portions of the branch pipe portions 23 and 24 are referred to as large-diameter portions 40). The semi-circular portions 34*a*, 34*b*, 35*a* and 35*b* of the inner pipe retainers 34 and 35 are connected to the large-diameter portions 40.

In addition, the pipe diameter of the downstream portion of the collecting pipe portion 22 is smaller than the pipe diameter of a portion other than the downstream portion of the collecting pipe portion 22 (hereinafter, the downstream portion of the collecting pipe portion 22 is referred to as small-diameter portion 41). The reinforcement pipe 31 is attached to the small-diameter portion 41.

In addition, as shown in FIG. 1 and FIG. 2, the downstream pipes 14*a* and 14*b* each are formed of an inner pipe and an outer pipe that covers the outer peripheral portion of the inner pipe so as to define a certain gap between the inner pipe and the outer pipe, and the upstream portions of the downstream pipes 14*a* and 14*b* are respectively connected to the downstream portions of the outer pipes 26 by welding, or the like.

In addition, the downstream portions of the downstream pipes 14*a* and 14*b* are collected by a collecting pipe 16. A flange portion 17 is provided for the collecting pipe 16. The flange portion 17 is connected to a catalytic device (not shown).

The catalytic device includes a known three-way catalyst. The catalytic device reduces or oxidizes harmful substances, such as nitrogen oxides, contained in exhaust gas to harmless substances, such as water, carbon dioxide and nitrogen. The catalytic device controls the air-fuel ratio of the engine within a predetermined range, and maintains the concentration of oxygen in exhaust gas within a certain range to obtain highly efficient exhaust gas purification performance.

In addition, in the catalytic device, normally, the reducing ability of the three-way catalyst is low at room temperature, and the three-way catalyst is easily damaged when continuously exposed to an excessive high temperature or vibrations. Therefore, it is necessary to warm the engine by heat of exhaust gas so that the reducing ability of the three-way catalyst is activated early after the engine is started.

Next, the operation will be described. During operation of the engine, in the cylinders, that is, the first cylinder to the fourth cylinder, the intake stroke, compression stroke, combustion and expansion stroke, and exhaust stroke are repeated in a predetermined combustion order. Then, for example, when the first cylinder is in the combustion and expansion stroke, the second cylinder to the fourth cylinder are respectively substantially in the exhaust stroke, compression stroke and intake stroke. When the first cylinder is in the exhaust stroke, the second cylinder to the fourth cylinder are respectively substantially in the intake stroke, combustion and expansion stroke and compression stroke. When the first cylinder is in the intake stroke, the second cylinder to the fourth cylinder are respectively substantially in the compression stroke, exhaust stroke and combustion and expansion stroke. When the first cylinder is in the compression stroke, the second cylinder to the fourth cylinder are respectively substantially in the combustion and expansion stroke, intake stroke and exhaust stroke.

In the exhaust manifold 11 according to the present embodiment, which is attached to the above engine, the upstream pipe 12*a* that is in fluid communication with the first cylinder and the upstream pipe 12*d* that is in fluid communication with the fourth cylinder are connected to the double collecting pipe 13B. Thus, exhaust gas exhausted from the exhaust port of the first cylinder and the exhaust port of the fourth cylinder is introduced into the double collecting pipe 13B through the upstream pipes 12*a* and 12*d*.

In addition, the upstream pipe 12*b* that is in fluid communication with the second cylinder and the upstream pipe 12*c* that is in fluid communication with the third cylinder are connected to the double collecting pipe 13A. Thus, exhaust gas exhausted from the exhaust port of the second cylinder and the exhaust port of the third cylinder is introduced into the double collecting pipe 13A through the upstream pipes 12*b* and 12*c*.

The upstream pipes 12*a* to 12*d* according to the present embodiment each have a double pipe structure, so the heat capacity of each inner pipe 12*n* is small, and the temperature of each inner pipe 12*n* early increases. In addition, the inner pipes 12*n* are covered with the air layer that is defined by the gap S1, so heat radiation from the inner pipes 12*n* to the outer pipes 12*m* is reduced to insulate heat of exhaust gas.

In addition, exhaust gas introduced into the double collecting pipes 13A and 13B joins at the collecting pipe portions 22 through the corresponding branch pipe portions 23 and 24, and is introduced into the downstream pipes 14*a* and 14*b* having a double pipe structure, and is then exhausted toward the catalytic device while the heat of exhaust gas is insulated by the downstream pipes 14*a* and 14*b*.

The double collecting pipes 13A and 13B according to the present embodiment each has a double pipe structure that includes the thin inner pipe 25 and the thick outer pipe 26 that covers the outer peripheral portion of the inner pipe 25 via the gap S. The gap S defines the air layer between the inner pipe 25 and the outer pipe 26. Thus, the heat capacity of the inner pipe 25 is small, and the temperature of the inner pipe 25 early increases. In addition, the inner pipe 25 is surrounded by the air layer, so heat radiation from the inner pipe 25 to the outer pipe 26 is reduced, and heat of exhaust gas is insulated. Thus, when the engine is cold, activation of the catalytic device provided downstream of the double collecting pipes 13A and 13B is facilitated, and the exhaust gas purification performance improves.

On the other hand, the inner pipe 25 is thinner than the outer pipe 26. Therefore, when the inner pipe 25 is exposed to high-temperature exhaust gas, a difference in thermal expansion between the inner pipe 25 and the outer pipe 26 increases. This causes a deformation in the collecting pipe portion 22 and branch pipe portions 23 and 24 of the inner pipe 25. Particularly, as a deformation occurs in the branch pipe portions 23 and 24 in the radial direction, the thin-walled portion 21 deforms to lift. This may cause damage such that cracks, or the like, occur in the thin-walled portion 21.

In the present embodiment, the inner pipe retainer 34 interposed between the thin inner pipe 25 and the thick outer pipe 26 is formed of the semi-circular portions 34*a* and 34*b* and the connecting portion 34*c*, and the inner pipe retainer 35 interposed between the thin inner pipe 25 and the thick outer pipe 26 is formed of the semi-circular portions 35*a* and 35*b* and the connecting portion 35*c*. The semi-circular portions 34*a*, 34*b*, 35*a* and 35*b* are connected to the outer peripheral portions of the branch pipe portions 23 and 24 and the inner pipe portion of the outer pipe 26 at the spot-welded portions 53 and 54. The connecting portions 34*c* and 35*c* are respectively integrated with the semi-circular portions 34*a* and 34*b*, 35*a* and 35*b*, and respectively connect the semi-circular portions 34*a* and 34*b*, 35*a* and 35*b*. In a state where the pair of branch pipe portions 23 and 24 are held by the inner pipe retainers 34 and 35, the inner pipe 25 is fixed to the outer pipe 26 via the inner pipe retainers 34 and 35.

Furthermore, the total area of the spot-welded portions 53 and 54 formed between the outer peripheral portions of the branch pipe portions 23 and 24 and the inner peripheral portions of the semi-circular portions 34*a*, 34*b*, 35*a* and 35*b* is larger than the total area of the spot-welded portions 51 and 52 formed between the inner peripheral portion of the outer pipe 26 and the outer peripheral portions of the semi-circular portions 34*a*, 34*b*, 35*a* and 35*b*. Thus, the semi-circular portions 34*a*, 34*b*, 35*a* and 35*b* of the inner pipe retainers 34 and 35, which are welded at the spot-welded portions 51 and 52 having a large total area to the inner pipe 25 exposed to high-temperature exhaust gas, may be heated to high temperature by heat radiated from the inner pipe 25.

In addition, the semi-circular portions 34*a*, 34*b*, 35*a* and 35*b* of the inner pipe retainers 34 and 35 are welded at the spot-welded portions 53 and 54 having a small total area to the outer pipe 26 exposed to low-temperature outside air. This can reduce the contact area between the semi-circular portions 34*a*, 34*b*, 35*a* and 35*b* of the inner pipe retainers 34 and 35 and the outer pipe 26. Thus, it is possible to make it hard for heat to be transferred from the inner pipe retainers 34 and 35 to the outer pipe 26. Thus, it is possible to reduce a temperature difference between the inner pipe 25 and the inner pipe retainers 34 and 35.

Therefore, even when the inner pipe 25 is made thinnest, it is possible to reduce a deformation of the inner pipe 25 with respect to the inner pipe retainers 34 and 35. In addition to this, the semi-circular portions 34*a*, 34*b*, 35*a* and 35*b* connected to the outer peripheral portions of the branch pipe portions 23 and 24 are connected at the connecting portions 34*c* and 35*c* to connect the pair of branch pipe portions 23 and 24 by the inner pipe retainers 34 and 35. Thus, a deformation in the direction in which the branch pipe portions 23 and 24 of the inner pipe 25 get close to each other is reduced to thereby make it possible to reduce stress of the thin-walled portion 21 of the branch pipe portions 23 and 24. As a result, it is possible to prevent damage such that cracks, or the like, occur in the thin-walled portion 21 of the branch pipe portions 23 and 24. Thus, it is possible to improve reliability of the exhaust manifold 11. In addition, it is possible to reduce stress of the welding surfaces between the branch pipe portions 23 and 24 and the inner pipe retainers 34 and 35, so the strength at which the inner pipe 25 is attached may be ensured, and reliability of the exhaust manifold 11 may be further improved.

In addition, in the present embodiment, the pair of branch pipe portions 23 and 24 are connected by the thin-walled portion 21, and the connecting portions 34*c* and 35*c*, other than portions that clamp the thin-walled portion 21, are connected by the spot-welded portions 55. Thus, when the thin inner pipe 25 is thermally expanded by high-temperature exhaust gas, it is possible to allow a deformation of the thin-walled portion 21. Therefore, it is possible to prevent an increase in stress of the thin-walled portion 21, and it is possible to further prevent damage to the thin-walled portion 21, which is the branched portion of the branch pipe portions 23 and 24. In addition, the connecting portions 34*c* and 35*c* of the inner pipe retainers 34 and 35, which are thicker than the thin-walled portion 21, are connected to make it possible to clamp the branch pipe portions 23 and 24 by the inner pipe retainers 34 and 35. Thus, it is possible to prevent a deformation such that the branch pipe portions 23 and 24 radially increase their diameters by the pressure of exhaust gas introduced into the inner pipe 25.

In addition, the pair of inner pipe retainers 34 and 35 that have a half shape are interposed between the inner pipe 25 and the outer pipe 26 so as to define the certain gap S between the inner pipe 25 and the outer pipe 26. The inner pipe retainers 34 and 35 are welded to the inner pipe 25 and the outer pipe 26. Then, the inner pipe retainers 34 and 35 are formed to include the semi-circular portions 34*a*, 34*b*, 35*a* and 35*b* and the connecting portions 34*c* and 35*c*. The semi-circular portions 34*a*, 34*b*, 35*a* and 35*b* are connected to the outer peripheral portions of the branch pipe portions 23 and 24 and the inner peripheral portion of the outer pipe 26. The connecting portions 34*c* and 35*c* are integrated with the semi-circular portions 34*a* and 34*b*, 35*a* and 35*b* and connect the semi-circular portions 34*a* and 34*b*, 35*a* and 35*b*, respectively. Thus, the inner pipe 25 is fixed to the outer pipe 26 via the inner pipe retainers 34 and 35 in a state where the pair of branch pipe portions 23 and 24 are held by the inner pipe retainers 34 and 35.

Therefore, even when a difference in temperature increases between the outer pipe 26 exposed to low-temperature outside air and the inner pipe 25 exposed to high-temperature exhaust gas, the inner pipe retainers 34 and 35 interposed between the inner pipe 25 and the outer pipe 26 allows heat of the inner pipe 25 to be transferred to the inner pipe retainers 34 and 35. This can reduce a difference in temperature between the inner pipe 25 and the inner pipe retainers 34 and 35.

Thus, it is possible to reduce a deformation of the inner pipe 25 with respect to the inner pipe retainers 34 and 35, and a deformation in a direction in which the branch pipe portions 23 and 24 of the inner pipe 25 get close to each other is reduced, and it is possible to reduce stress of the thin-walled portion 21 of the branch pipe portions 23 and 24. As a result, this suppresses a lift of the thin-walled portion 21 of the branch pipe portions 23 and 24, and it is possible to prevent damage such that cracks, or the like, occur in the thin-walled portion 21 of the branch pipe portions 23 and 24. Thus, it is possible to improve reliability of the exhaust manifold 11.

In addition, it is possible to reduce stress of the spot-welded portions 51 and 52 between the branch pipe portions 23 and 24 and the inner pipe retainers 34 and 35, so the strength at which the inner pipe 25 is attached may be ensured, and reliability of the exhaust manifold 11 may be further improved.

In addition, in the present embodiment, the thickness of the outer pipe 26 is larger than the thickness of the inner pipe 25, and the thickness of each of the inner pipe retainers 34 and 35 is larger than the thickness of the inner pipe 25 and is smaller than the thickness of the outer pipe 26. Thus, the heat capacity of the inner pipe 25 exposed to high-temperature exhaust gas is reduced, and the air layer (heat insulating layer) having a sufficient size may be provided between the inner pipe 25 and the outer pipe 26. Hence, it is possible to insulate heat of exhaust gas.

In addition, the thickness of each of the inner pipe retainers 34 and 35 is larger than the thickness of the inner pipe 25, so a difference in temperature between the inner pipe 25 and the inner pipe retainers 34 and 35 may be further reduced, and it is possible to further reduce a deformation of the inner pipe 25 with respect to the inner pipe retainers 34 and 35.

In addition, when exhaust gas is introduced into the double collecting pipes 13A and 13B, the branch pipe portions 23 and 24 and the collecting pipe portion 22 radially deform because of the pressure of exhaust gas. In the present embodiment, the connecting portions 34*c* and 35*c* of the inner pipe retainers 34 and 35 that are thicker than the inner pipe 25 are connected to clamp the upstream portions of the branch pipe portions 23 and 24, and the reinforcement pipe 31 that is thicker than the inner pipe 25 is connected to the downstream portion of the collecting pipe portion 22 to reinforce the upstream portions and downstream portion of the inner pipe 25. This prevents a deformation such that the branch pipe portions 23 and 24 and the collecting pipe portion 22 radially increase their diameters by the pressure of exhaust gas.

Incidentally, when the opening diameter of each of the branch pipe portions 23 and 24 and collecting pipe portion 22 is constant, stress concentrates on portions of the branch pipe portions 23 and 24 and collecting pipe portion 22 located at end portions (indicated by the arrows R1 in FIG. 7 and FIG. 8) of the inner pipe retainers 34 and 35 that are thicker than the inner pipe 25 and at an end portion (indicated by the arrow R2 in FIG. 7 and FIG. 8) of the reinforcement pipe 31 that is thicker than the inner pipe 25. This may damage the portions, corresponding to the end portions R1 and R2, of the branch pipe portions 23 and 24 and collecting pipe portion 22.

In the present embodiment, the large-diameter portions 40 are respectively formed at the upstream portions of the branch pipe portions 23 and 24 of the inner pipe 25, and the small-diameter portion 41 is formed at the downstream portion of the collecting pipe portion 22. Thus, the inner diameter of each large-diameter portion 40 is varied from the inner diameter of each of the branch pipe portions 23 and 24 located downstream of the large-diameter portions 40, and the inner diameter of the small-diameter portion 41 is varied from the inner diameter of the collecting pipe portion 22 located upstream of the small-diameter portion 41.

Thus, stress that radially acts on the branch pipe portions 23 and 24 and the collecting pipe portion 22 because of exhaust gas may be distributed by the large-diameter portions 40 and the small-diameter portion 41 of which the diameters are variable. This can prevent concentration of stress on the portions, corresponding to the end portions R1 of the inner pipe retainers 34 and 35, of the branch pipe portions 23 and 24 and the portion, corresponding to the end portion R2 of the reinforcement pipe 31, of the collecting pipe portion 22. Thus, it is possible to prevent damage to the portions of the branch pipe portions 23 and 24 and collecting pipe portion 22, which are located at the end portions R1 and R2 of the inner pipe retainers 34 and 35 and the reinforcement pipe 31.

In addition, in the present embodiment, the front slits 29 are formed at the upstream portions of the branch pipe portions 23 and 24 in the exhaust direction in which exhaust gas flows, and the inner peripheral side of the branch pipe portions 23 and 24 is in fluid communication with the gap S between the inner pipe 25 and the outer pipe 26 via the front slits 29. Thus, immediately before exhaust gas introduced to the upstream sides of the branch pipe portions 23 and 24 in the exhaust direction is introduced into the collecting pipe portion 22, part of the exhaust gas may be exhausted into the gap S between the inner pipe 25 and the outer pipe 26 via the front slits 29. This can reduce a deformation that occurs in the thin-walled portion 21 of the branch pipe portions 23 and 24 because of high-temperature exhaust gas exhausted from the exhaust ports of the cylinders to the pair of branch pipe portions 23 and 24.

That is, the pair of branch pipe portions 23 and 24 correspond to inlets of exhaust gas, and exhaust gas introduced into the pair of branch pipe portions 23 and 24 joins at the collecting pipe portion 22 that is in fluid communication with the pair of branch pipe portions 23 and 24. Thus, the flow rate of exhaust gas steeply increases to increase the pressure of exhaust gas, and, therefore, exhaust gas introduced into the branch pipe portions 23 and 24 has an extremely high temperature. This easily causes a deformation of the thin-walled portion 21 of the branch pipe portions 23 and 24.

In the present embodiment, part of exhaust gas introduced into the upstream side of the branch pipe portions 23 and 24 in the exhaust direction is exhausted into the gap S between the inner pipe 25 and the outer pipe 26 through the front slits 29 to reduce the flow rate of exhaust gas to thereby decrease the pressure of exhaust gas. Thus, it is possible to suppress an increase in temperature of exhaust gas introduced into the branch pipe portions 23 and 24. Therefore, it is possible to further reduce a deformation that occurs in the thin-walled portion 21 of the branch pipe portions 23 and 24.

In addition, in the present embodiment, the rear slits 30 are formed at the downstream portion of the collecting pipe portion 22 in the exhaust direction, and the inner peripheral side of the collecting pipe portion 22 is in fluid communication with the gap S between the inner pipe 25 and the outer pipe 26 via the rear slits 30. Thus, part of exhaust gas that joins at the collecting pipe portion 22 through the branch pipe portions 23 and 24 may be exhausted to the gap S between the inner pipe 25 and the outer pipe 26 via the rear slits 30. This suppresses an increase in pressure of exhaust gas in the collecting pipe portion 22 due to exhaust gas that joins from the pair of branch pipe portions 23 and 24. Therefore, it is possible to suppress a deformation of the inner pipe 25 due to the pressure of exhaust gas.

In addition, in the present embodiment, as indicated by the broken line in FIG. 4 and FIG. 5, the welded portions A are provided at portions, other than the upstream portions and downstream portions, of the flange portions 27*a* and 28*a* in the extending directions in which the flange portions 27*a* and 28*a* extend. This can prevent concentration of stress on the upstream ends and downstream ends of the flange portions 27*a* and 28*a* in the extending directions due to the pressure of exhaust gas.

That is, when welding is applied over the entire range of the flange portions 27*a* and 28*a* in the extending directions, the upstream ends and downstream ends of the flange portions 27*a* and 28*a* in the extending directions respectively overlap the start end and termination end of welding. This causes concentration of stress on the upstream ends and downstream ends of the flange portions 27*a* and 28*a* in the extending directions due to the pressure of exhaust gas. Thus, the flange portions 27*a* and 28*a* deform in a direction to separate from each other, and there is a possibility that the welded portions peel off and reliability of welding deteriorates.

In the present embodiment, the welded portions A are set at the portions, other than the upstream portions and downstream portions, of the flange portions 27*a* and 28*a* in the extending directions. Thus, it is possible to concentrate stress on the start ends and termination ends of the welded portions away from the upstream ends and downstream ends of the flange portions 27*a* and 28*a* in the extending directions.

Therefore, the flange portions 27*a* and 28*a* are allowed to deform in a direction to separate non-welded portions at the upstream ends and downstream ends of the flange portions 27*a* and 28*a* about the start ends and termination ends of the welded portions located away from the upstream ends and downstream ends of the flange portions 27*a* and 28*a* in the extending directions. This can prevent the welded portions A from peeling off, and it is possible to improve reliability of welding.

In addition, in the present embodiment, the double collecting pipe 13A is connected to the upstream pipes 12*a* and 12*d* that are respectively in fluid communication with the first cylinder and the fourth cylinder of which the exhaust strokes do not take place at the same time, and the double collecting pipe 13B is connected to the upstream pipes 12*b* and 12*c* that are respectively in fluid communication with the second cylinder and the third cylinder of which the exhaust strokes do not take place at the same time. Thus, it is possible to reliably suppress exhaust interference between the cylinders of which combustion strokes take place sequentially. Hence, it is possible to reliably prevent a decrease in torque performance at a low rotational speed range of the engine.

Note that the structure in which the double collecting pipes 13A and 13B are connected to the upstream pipes 12*a* to 12*d* according to the present embodiment is not limited to the above. Instead, it is also applicable that the adjacent upstream pipes 12*a* and 12*b* are connected to the double collecting pipe 13A and the adjacent upstream pipes 12*c* and 12*d* are connected to the double collecting pipe 13B.

By so doing, the upstream pipes 12*a* and 12*d* that are located away from each other are not connected to the double collecting pipe 13B. This can reduce space for attaching the exhaust manifold 11 and further simplify the configuration of the exhaust manifold 11.

In addition, the front slits 29 and the rear slits 30 are respectively formed at the facing surfaces of the upstream portions of the branch pipe portions 23 and 24 and the downstream portion of the collecting pipe portion 22; however, the configuration is not limited. Instead, it is also applicable that the front slits 29 and the rear slits 30 are formed at any portions, in the circumferential directions, of the upstream portions of the branch pipe portions 23 and 24 and the downstream portion of the collecting pipe portion 22.

In short, it is only necessary that the inner peripheral side of the branch pipe portions 23 and 24 is in fluid communication with the gap S between the inner pipe 25 and the outer pipe 26 via the front slits, and it is only necessary that the inner peripheral side of the collecting pipe portion 22 is in fluid communication with the gap S between the inner pipe 25 and the outer pipe 26 via the rear slits.

In addition, the embodiment described above is illustrative in all respects and is not restrictive. The scope of the invention is defined by the appended claims rather than the above description. The scope of the invention is intended to encompass all modifications within the scope of the appended claims and equivalents thereof.

As described above, the exhaust manifold according to the aspect of the invention has advantages such that it is possible to prevent damage to the branched portion by reducing the stress of the branch pipe portions of the inner pipe when the inner pipe is subjected to high-temperature exhaust gas, and it is possible to improve reliability of the exhaust manifold. The exhaust manifold according to the aspect of the invention is useful as the exhaust manifold, or the like, that introduces exhaust gas from exhaust ports of a set of cylinders into a double collecting pipe.

In the exhaust manifold according to the aspect of the invention, a pair of the inner pipe retainers may be provided.

In the exhaust manifold according to the aspect of the invention, the inner pipe may have a thin-walled portion that connects the branched portions of the branch pipe portions, the inner pipe retainers may be connected to the inner pipe by spot-welding so that portions of the connecting portions of the pair of inner pipe retainers clamp the thin-walled portion, and other portions of the connecting portions of the pair of inner pipe retainers may be connected by spot-welding.

In the exhaust manifold according to the aspect of the invention, a slit may be formed in a large-diameter portion, which is an upstream portion of each branch pipe portion in an exhaust direction in which exhaust gas flows, and an inner peripheral side of each branch pipe portion may be in fluid communication with the gap, defined between the inner pipe and the outer pipe, via the slit.

In the exhaust manifold according to the aspect of the invention, a slit may be formed in a small-diameter portion, which is a downstream portion of the collecting pipe portion in an exhaust direction in which exhaust gas flows, and an inner peripheral side of the collecting pipe portion may be in fluid communication with the gap, defined between the inner pipe and the outer pipe, via the slit.

In the exhaust manifold according to the aspect of the invention, the engine may be an in-line four-cylinder engine, a pair of the double collecting pipes may be provided, and exhaust gas from exhaust ports of a set of the cylinders in which exhaust strokes do not take place at the same time may be introduced into the branch pipe portions that constitute one of the double collecting pipes, and exhaust gas from exhaust ports of the remaining set of the cylinders in which exhaust strokes do not take place at the same time may be introduced into the branch pipe portions that constitute the other one of the double collecting pipes.

In the exhaust manifold according to the aspect of the invention, the connecting portion may be integrated with the corresponding pair of semi-circular portions.

In the exhaust manifold according to the aspect of the invention, the connecting portions of the pair of inner pipe retainers may be connected to each other so that the semi-circular portions of the pair of inner pipe retainers clamp the branch pipe portions.

In the exhaust manifold according to the aspect of the invention, the inner pipe retainer may have a half shape.

In the exhaust manifold according to the aspect of the invention, each connecting portion may have a linear shape.

In the exhaust manifold according to the aspect of the invention, an outer peripheral portion of each large-diameter portion may be connected to the inner pipe retainer, and each large-diameter portion may have an inner diameter that is larger than that of a portion of each branch pipe portion, other than the large-diameter portion.

The exhaust manifold according to the aspect of the invention may further include a cylindrical reinforcement member that is connected to the small-diameter portion so as to close part of the slit formed in the small-diameter portion, and the small-diameter portion may have an inner diameter that is smaller than that of a portion of the collecting pipe portion, other than the small-diameter portion.

In the exhaust manifold according to the aspect of the invention, the reinforcement member may suppress an increase in diameter of the small-diameter portion.

In the exhaust manifold according to the aspect of the invention, the inner pipe retainer may suppress an increase in diameter of each large-diameter portion.

What is claimed is:

1. An exhaust manifold comprising:

a double collecting pipe that is formed of an inner pipe and an outer pipe, wherein the inner pipe includes a collecting pipe portion and branch pipe portions that are bifurcated from the collecting pipe portion, the outer pipe covers an outer peripheral portion of the collecting pipe portion and outer peripheral portions of the branch pipe portions, and the double collecting pipe is formed so that the thickness of the inner pipe is smaller than the thickness of the outer pipe; and an inner pipe retainer that has a thickness larger than the thickness of the inner pipe and smaller than the thickness of the outer pipe and that is formed of a pair of semi-circular portions and a connecting portion, wherein the pair of semi-circular portions are respectively connected to outer peripheral portions of branched portions of the branch pipe portions and an inner peripheral portion of the outer pipe, the connecting portion connects the pair of semi-circular portions, and the inner pipe retainer is interposed between the inner pipe and the outer pipe and is connected to the inner pipe and the outer pipe so as to define a certain gap between the inner pipe and the outer pipe, wherein exhaust gas exhausted from exhaust ports of a set of cylinders among a plurality of cylinders of an engine is introduced into the collecting pipe portion through the branch pipe portions, and the inner peripheral portion of the outer pipe and outer peripheral portions of the semi-circular portions are connected by spot-welding, the outer peripheral portions of the branch pipe portions and inner peripheral portions of the semi-circular portions are connected by spot-welding, the total area in which the outer peripheral portions of the branch pipe portions and the inner peripheral portions of the semi-circular portions are spot-welded is larger than the total area in which the inner peripheral portion of the outer pipe and the outer peripheral portions of the semi-circular portions are spot-welded.

2. The exhaust manifold according to claim 1, wherein the engine is an in-line four-cylinder engine, a pair of the double collecting pipes are provided, and exhaust gas from exhaust ports of a set of the cylinders in which exhaust strokes do not take place at the same time is introduced into the branch pipe portions that constitute one of the double collecting pipes, and exhaust gas from exhaust ports of the remaining set of the cylinders in which exhaust strokes do not take place at the same time is introduced into the branch pipe portions that constitute the other one of the double collecting pipes.

3. The exhaust manifold according to claim 1, wherein the connecting portion is integrated with the corresponding pair of semi-circular portions.

4. The exhaust manifold according to claim 1, wherein a contact area between the inner peripheral portion of the outer pipe and outer peripheral portions of the semi-circular portions is smaller than a contact area between the outer peripheral portions of the branch pipe portions and inner peripheral portions of the semi-circular portions.

5. The exhaust manifold according to claim 1, wherein a slit is formed in a large-diameter portion, which is an upstream portion of each branch pipe portion in an exhaust direction in which exhaust gas flows, and an inner peripheral side of each branch pipe portion is in fluid communication with the gap, defined between the inner pipe and the outer pipe, via the slit.

6. The exhaust manifold according to claim 5, wherein an outer peripheral portion of each large-diameter portion is connected to the inner pipe retainer, and each large-diameter portion has an inner diameter that is larger than that of a portion of each branch pipe portion, other than the large-diameter portion.

7. The exhaust manifold according to claim 5, wherein the inner pipe retainer suppresses an increase in diameter of each large-diameter portion.

8. The exhaust manifold according to claim 1, wherein a pair of the inner pipe retainers are provided, each inner pipe retainer including a connecting portion.

9. The exhaust manifold according to claim 2, wherein the inner pipe has a thin-walled portion that connects the branched portions of the branch pipe portions, the inner pipe retainers are connected to the inner pipe by spot-welding so that portions of the connecting portions of the pair of inner pipe retainers clamp the thin-walled portion, and other portions of the connecting portions of the pair of inner pipe retainers are connected by spot-welding.

10. The exhaust manifold according to claim 8, wherein the connecting portions of the pair of inner pipe retainers are connected to each other so that the semi-circular portions of the pair of inner pipe retainers clamp the branch pipe portions.

11. The exhaust manifold according to claim 8, wherein each connecting portion has a planar shape.

12. The exhaust manifold according to claim 1, wherein a slit is formed in a small-diameter portion, which is a downstream portion of the collecting pipe portion in an exhaust direction in which exhaust gas flows, and an inner peripheral side of the collecting pipe portion is in fluid communication with the gap, defined between the inner pipe and the outer pipe, via the slit.

13. The exhaust manifold according to claim 12, further comprising:

a cylindrical reinforcement member that is connected to the small-diameter portion so as to close part of the slit formed in the small-diameter portion, wherein the small-diameter portion has an inner diameter that is smaller than that of a portion of the collecting pipe portion, other than the small-diameter portion.

14. The exhaust manifold according to claim 13, wherein the reinforcement member suppresses an increase in diameter of the small-diameter portion.

* * * * *